US005664436A

United States Patent [19]

Hawkins, Jr. et al.

[11] Patent Number: 5,664,436

[45] Date of Patent: Sep. 9, 1997

[54] COMPONENT CONFIGURATION FOR ENHANCING DISPENSER SERVICEABILITY

[75] Inventors: John Thomas Hawkins, Jr., Adkins; Ernest Matthew Chavana, Jr., San Antonio, both of Tex.

[73] Assignee: Lancer Corporation

[21] Appl. No.: 638,836

[22] Filed: Apr. 29, 1996

[51] Int. Cl.[6] ..... B67D 5/62; B67D 5/56; A47B 96/00

[52] U.S. Cl. ..... 62/390; 222/146.6; 222/129.1; 312/270.2

[58] Field of Search ..... 62/389, 390, 392, 62/394; 222/146.6, 129.1; 312/236, 270.2, 223.1, 223.6

[56] References Cited

U.S. PATENT DOCUMENTS

| | | | |
|---|---|---|---|
| 3,422,634 | 1/1969 | Brown | 62/390 |
| 3,813,010 | 5/1974 | Hassell et al. | 222/129.1 |
| 4,545,505 | 10/1985 | Mueller et al. | 222/146.6 |
| 4,781,310 | 11/1988 | Credle et al. | 222/129.1 |
| 4,916,910 | 4/1990 | Schroeder | 62/59 |
| 5,368,198 | 11/1994 | Goulet | 222/129.1 |
| 5,452,951 | 9/1995 | Peller | 312/310 |
| 5,492,250 | 2/1996 | Sardynski | 222/108 |
| 5,568,362 | 10/1996 | Hansson | 361/736 |

FOREIGN PATENT DOCUMENTS

| | | | |
|---|---|---|---|
| WO93/02011 | 2/1993 | WIPO | 222/146.6 |

*Primary Examiner*—William Doerrler

*Attorney, Agent, or Firm*—Donald R. Comuzzi; Christopher L. Makay

[57] ABSTRACT

A component configuration for enhancing the serviceability of a dispenser includes a platform positionable on the housing of the dispenser. A refrigeration unit mounts at a center and rear portions of the platform. An electronic control is disposed within a housing that is mounted at a center portion of the platform adjacent to the refrigeration unit. The electronic control housing permits access to the electronic control from the front of the dispenser. An evaporator coil of the refrigeration unit includes concentric coil sections defined by an inner coil section, an intermediate coil section, and an outer coil section.

12 Claims, 8 Drawing Sheets

COMPONENT CONFIGURATION FOR ENHANCING DISPENSER SERVICEABILITY

BACKGROUND OF THE INVENTION

1. Field of the Invention

The present invention relates to beverage dispensers and, more particularly, but not by way of limitation, to a beverage dispenser configuration and design that simplifies maintenance.

2. Description of the Related Art

Many beverage dispensers currently used in the drink dispensing industry include a housing having a cooling chamber therein. The cooling chamber may contain product lines, a water line, and a carbonator. The housing holds a platform supporting a refrigeration unit, an agitator, and an electronic control system. The refrigeration unit includes a compressor and a condenser mounted on top of the platform and a condenser fan bolted at the rear of the condenser. A refrigeration unit evaporator coil mounts underneath the platform and extends into the cooling chamber. A carbonator pump, pump motor, and carbonator relief and check valves may be mounted behind a front panel of the housing. Dispensing valves mount to the front of the housing in a position in front of the refrigeration unit, the agitator, and the electronic control system. A bonnet mounts to the housing over the refrigeration unit, the agitator, and the electronic control system to provide the dispenser with an aesthetically pleasing appearance.

Although the above-described dispenser functions adequately in dispensing beverages at a desired temperature, servicing of that dispenser is difficult. The dispenser is typically located against a wall or in a corner to conserve space which makes its components difficult to reach. To access the refrigeration unit or the electronic control system, a technician must be either standing over or behind the dispenser. Illustratively, servicing the condenser fan is extremely difficult because the bolts securing it to the condenser face the rear of the dispenser. Accordingly, a technician must climb onto a structure near the dispenser, such as a countertop. Similarly, testing the carbonator or servicing either the carbonator pump or pump motor is difficult because the carbonator check valve, the pump, and the pump motor are located behind the front panel of the housing, resulting in the technician having to first remove the front panel.

Additionally, it is possible that the technician will not be able to reach the dispenser from a countertop. In that instance, the technician must service the dispenser from the front although certain components are in the rear of the dispenser and securing parts of the refrigeration unit and electronic control system, such as bolts, face either down or towards the rear of the dispenser. Thus, servicing the dispenser, particularly from the front, is difficult and time consuming which significantly increases the cost of maintaining and operating the dispenser.

Accordingly, a dispenser configuration that allows servicing from the front will significantly improve over current dispenser designs.

SUMMARY OF THE INVENTION

In accordance with the preferred embodiment of the present invention, a component configuration for enhancing the serviceability of a dispenser includes a platform positionable on the housing of the dispenser. A refrigeration unit mounts at a center and rear portions of the platform. An electronic control is disposed within a housing that is mounted at a center portion of the platform adjacent to the refrigeration unit. The electronic control housing permits access to the electronic control from the front of the dispenser.

The refrigeration unit includes a compressor mounted at a rear portion of the platform and a condenser mounted at a center portion of the platform. A shroud including a condenser fan mounted therein slides over the condenser to permit easy removal and replacement of the condenser fan. An agitator mounts at a rear center portion of the platform. An evaporator coil mounts underneath the platform and extends into a cooling chamber defined by the housing of the dispenser.

The evaporator coil includes concentric coil sections defined by an inner coil section, an intermediate coil section, and an outer coil section. Each of the inner coil section, the intermediate coil section, and the outer coil section develops a frozen cooling fluid portion that freezes with an adjacent portion thereby decreasing the formation time of a frozen cooling fluid bank. During peak use periods, channels between the inner coil section and the intermediate coil section and the intermediate coil section and the outer coil form to maximize the surface area contact between the frozen cooling fluid and the unfrozen cooling fluid. Furthermore, unfrozen cooling fluid melts cooling fluid frozen on the interior of the inner coil section to expose the evaporator coil thereby increasing heat transfer.

The electronic control housing includes a frame for supporting the electronic control. A jacket slides over the frame to protect the electronic control, however, the jacket is easily removable from the frame to expose the electronic control. The jacket includes an opening therethrough that exposes a switch of the electronic control. A door pivotally mounted to the frame supports first circuits of the electronic control. The door pivots between a closed position that provides access to the first circuits and an open position that exposes second circuits of the electronic control.

A carbonator pump motor mounts at a front portion of the platform. A carbonator pump attaches to and is supported by the carbonator pump motor. A relief valve, check valve, liquid level probe, and a cooling fluid bank size probe also mount at a front portion of the platform. The platform includes an opening therethrough positioned in front of the cooling fluid bank size probe. A frame mounted at the front portion of the platform includes a shelf for supporting dispensing pumps wherein the shelf resides at an angle to enhance the accessibility of the dispensing pumps. A bonnet mounts on the housing over the platform and includes a slot that allows the removal and replacement of a condenser filter. Dispensing valves mount to an upper front portion of the housing of the dispenser.

It is, therefore, an object of the present invention to provide a component configuration that enhances the serviceability of a dispenser.

It is another object of the present invention to provide a dispenser that may be serviced from the front.

It is a further object of the present invention to provide a dispenser with an evaporator coil that decreases the time required to form a frozen cooling fluid bank and, further, that enhances the heat exchange between the unfrozen cooling fluid and the frozen cooling fluid.

Still other objects, features, and advantages of the present invention will become evident to those of ordinary skill in the art in light of the following.

DETAILED DESCRIPTION OF THE PREFERRED EMBODIMENTS

Figure 1:
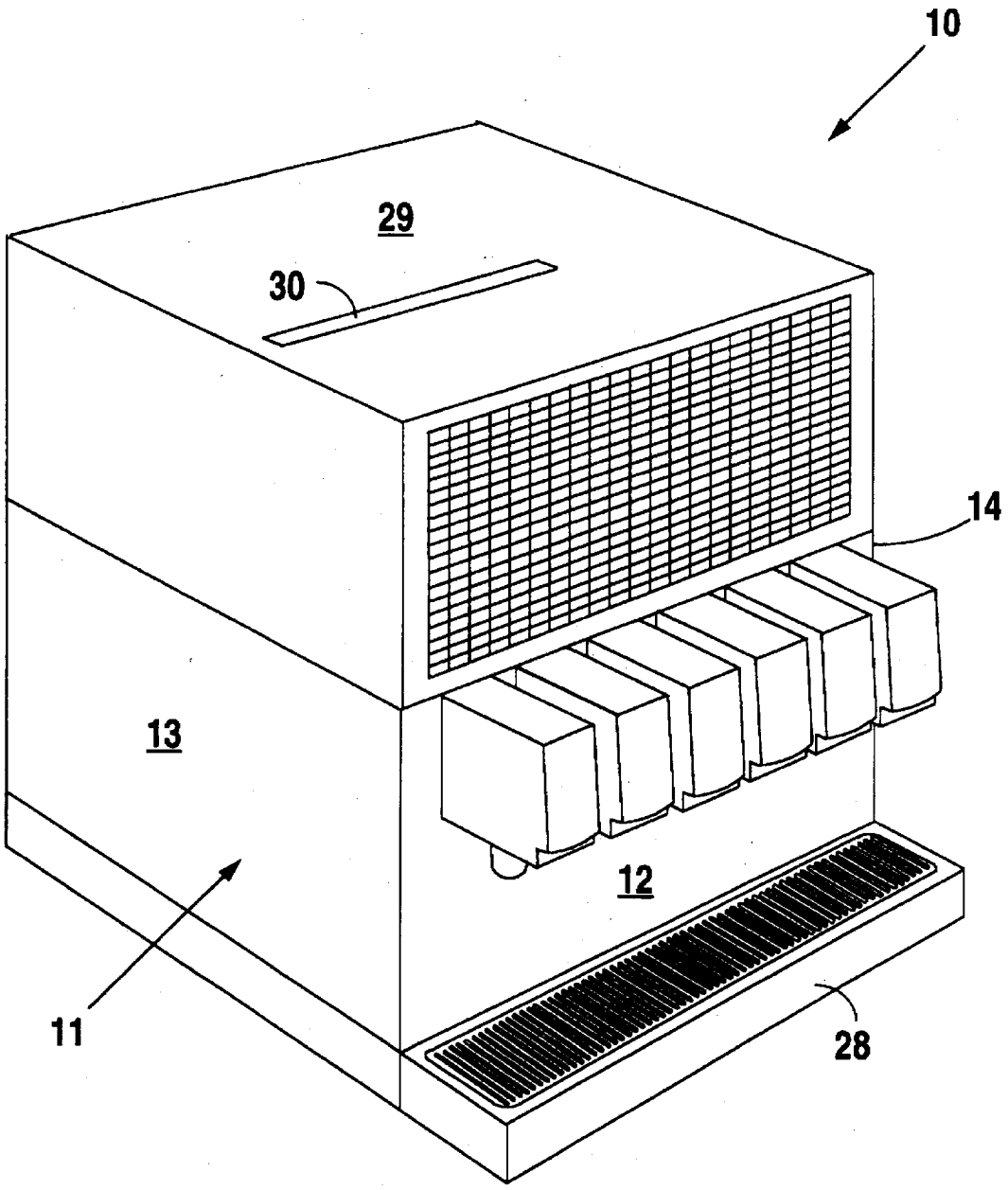
FIG. 1 is a perspective view illustrating the exterior of a dispenser according to the preferred embodiment.
Figure 2:
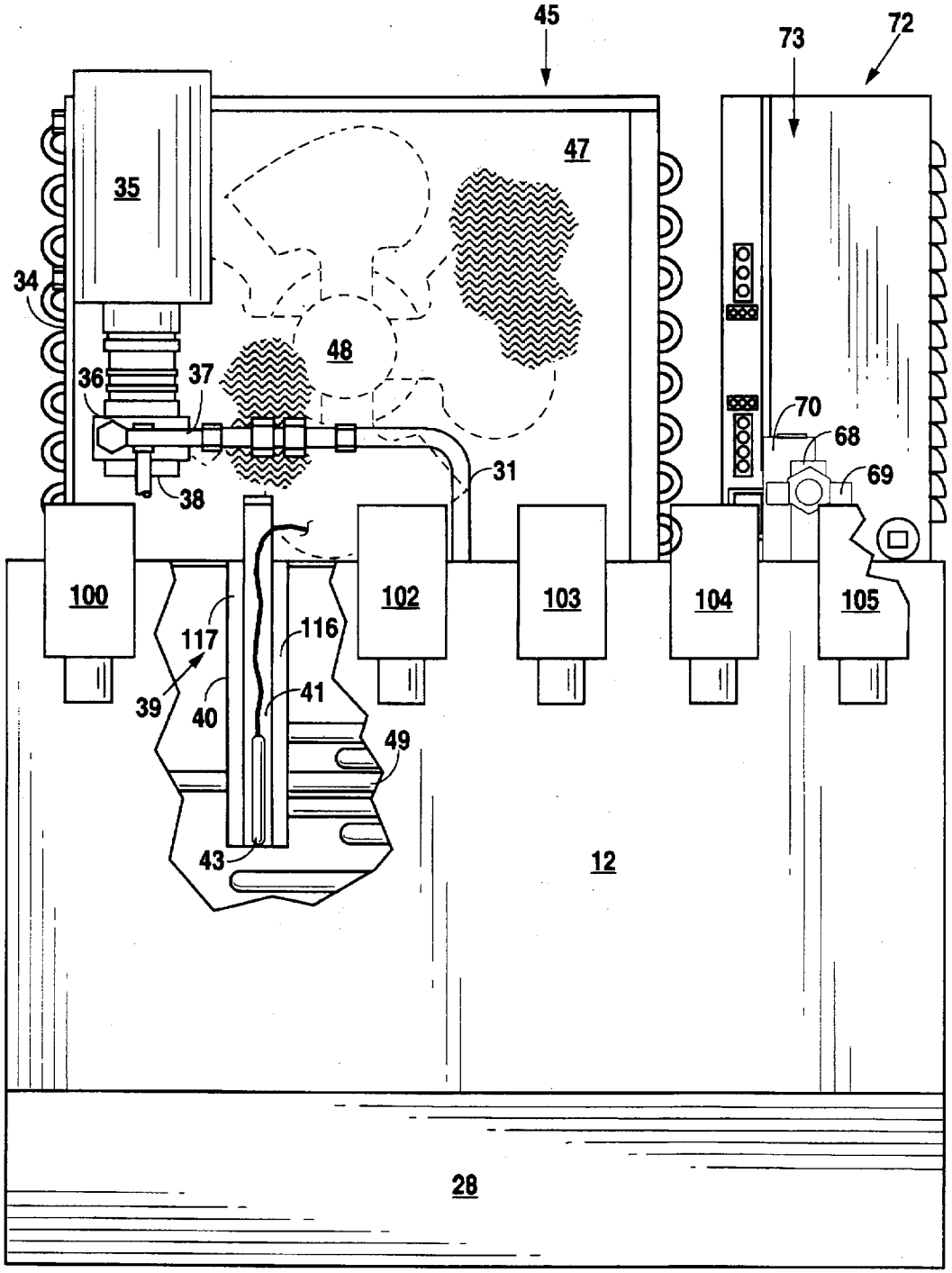
FIG. 2 is a front elevation view in partial cross-section illustrating the dispenser according to the preferred embodiment with its bonnet removed.
Figure 3:
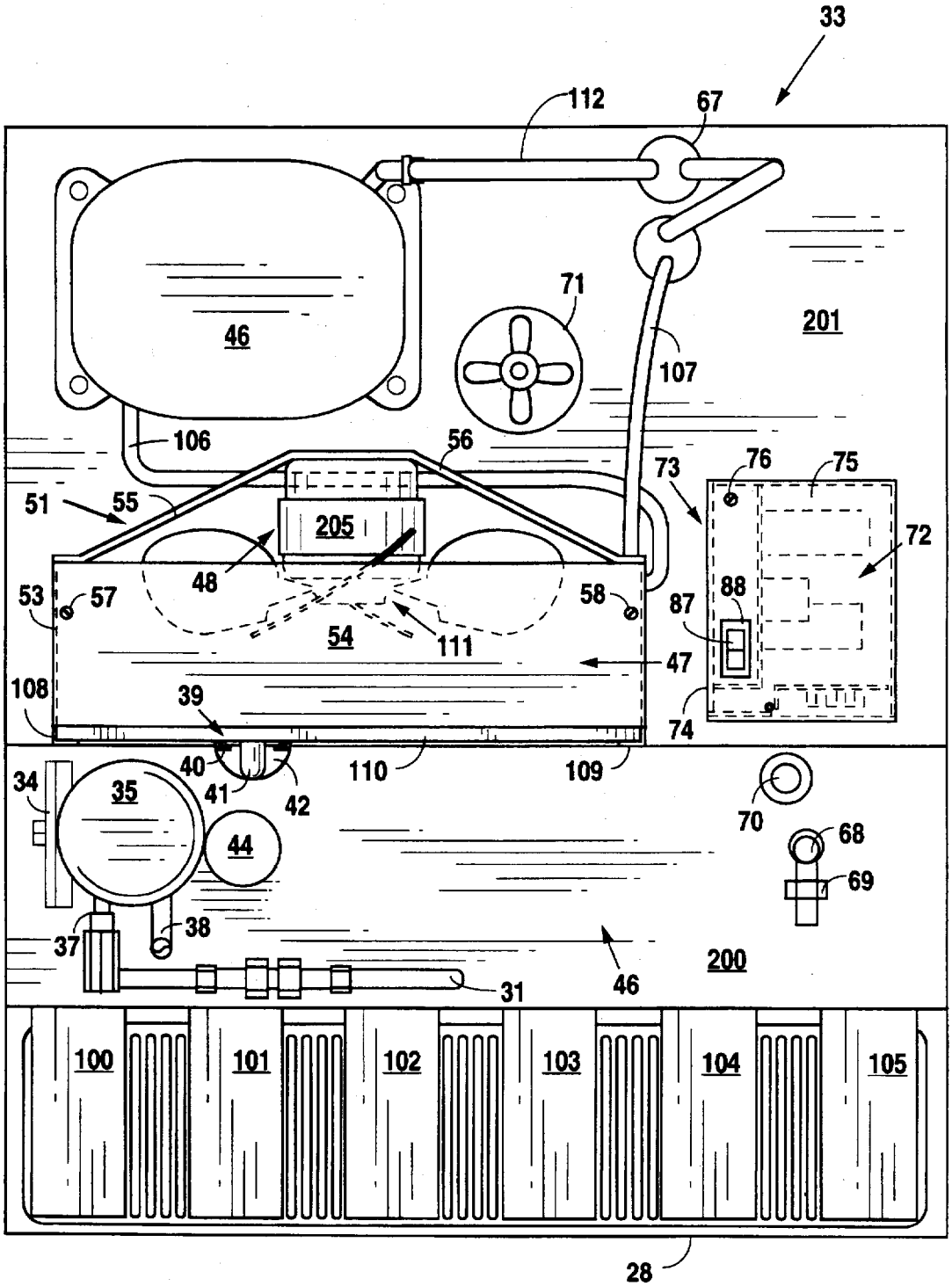
FIG. 3 is a top plan view illustrating the dispenser according to the preferred embodiment with its bonnet removed.
Figure 5:
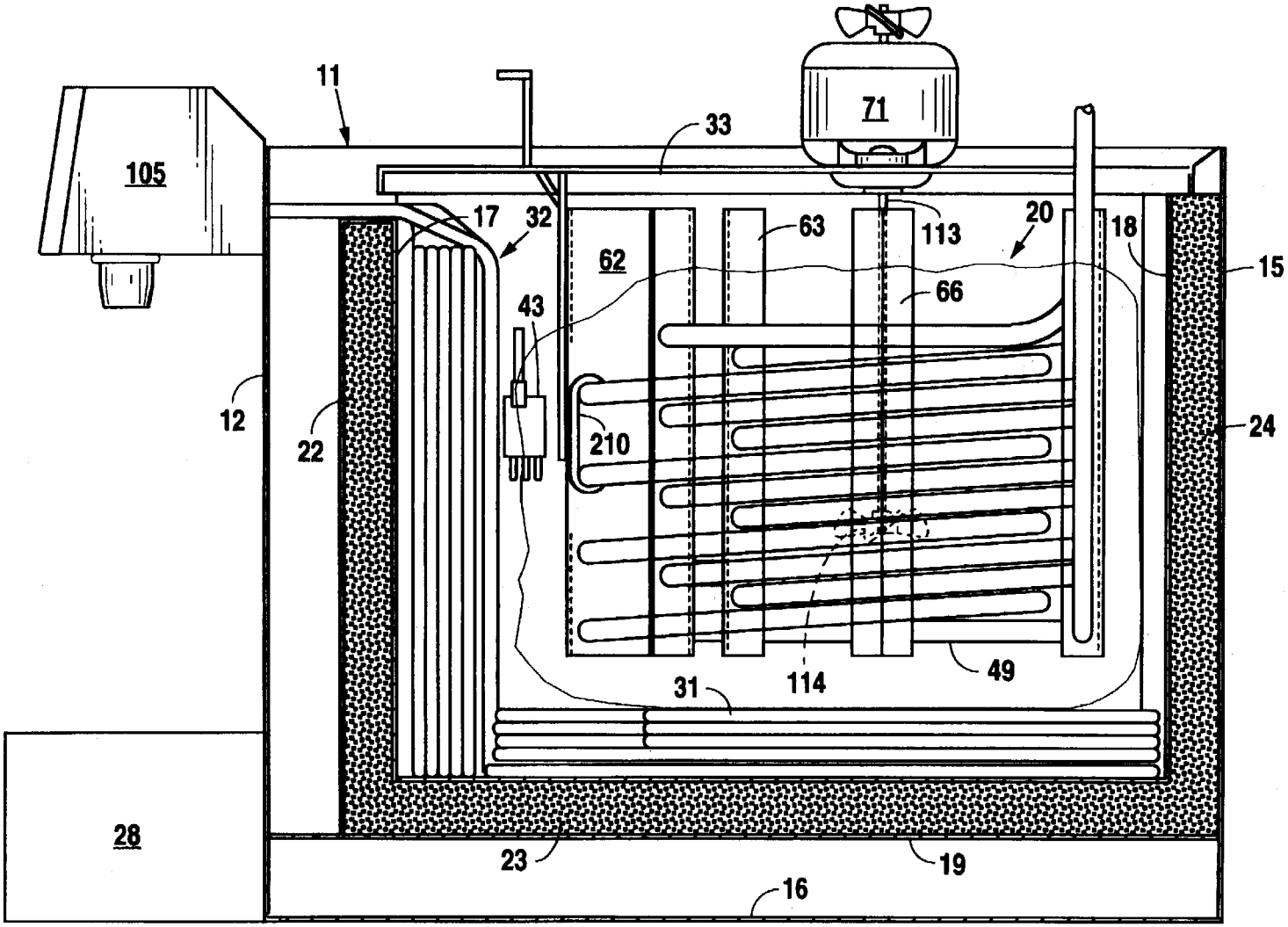
FIG. 5 is a right-side elevation view in cross-section illustrating the housing of the dispenser according to the preferred embodiment.
Figure 6:
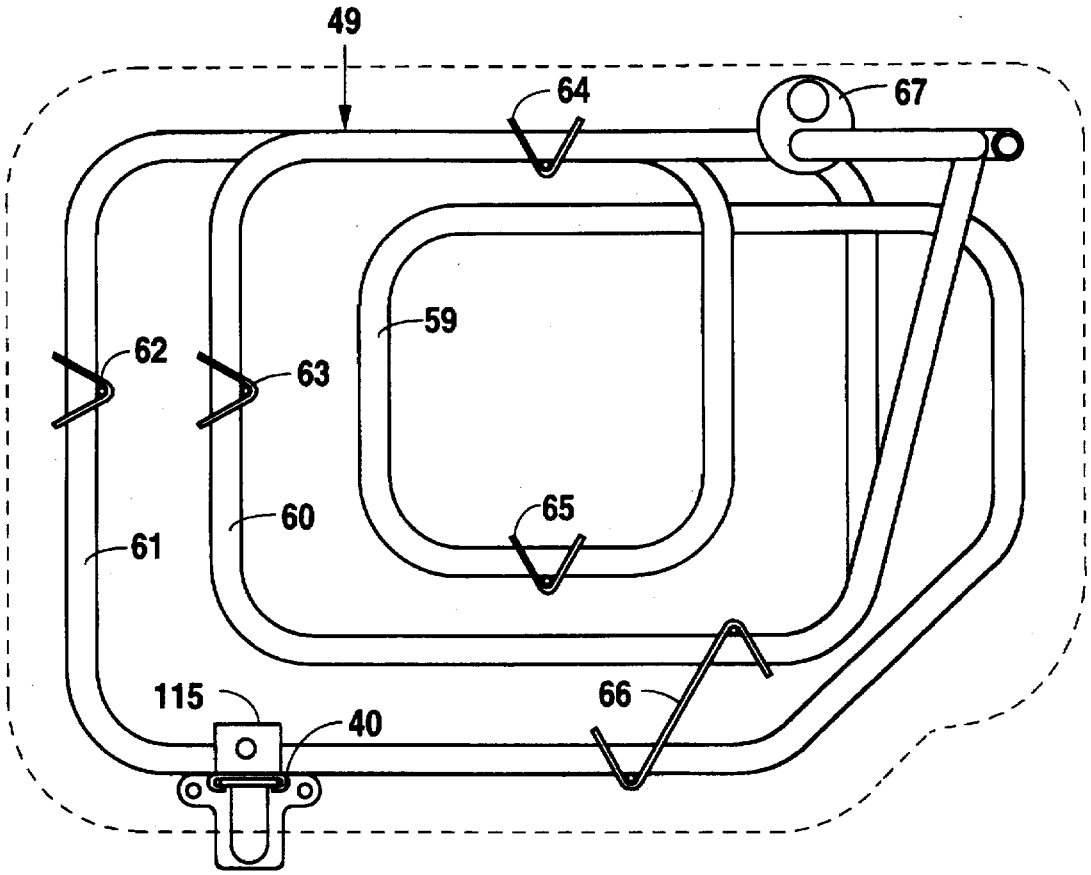
FIG. 6 is a top plan view illustrating the evaporator coil of the dispenser according to the preferred embodiment.

As illustrated in FIGS. 1 and 5, a dispenser 10 includes a housing 11 having an exterior front wall 12, two exterior side walls 13 and 14, an exterior rear wall 15, and an exterior bottom 16. The housing has an interior front wall 17, an interior rear wall 18, two interior side walls, and an interior bottom 19 that define a cooling chamber 20 for holding a cooling fluid such as water. An intermediate front wall 22, an intermediate bottom 23, side walls 13 and 14, and rear wall 15 define a channel with the cooling chamber 20 that receives an insulating material 24 that insulates the cooling chamber 20.

The dispenser 10 includes, in this preferred embodiment, dispensing valves 100–105 that mount to an upper portion of the front wall 12 using any suitable means such as screws. A drip tray 28 mounts to a bottom portion of the front wall 12 and includes a drain hole connected to a drain to deliver overflow thereto. The drip tray 28 mounts to the front wall 12 using any suitable means such as a bracket mounted to the drip tray 28 that engages pins on the front wall 12. The dispenser 10 further includes a bonnet 29 mounted onto the housing 11 to provide the dispenser 10 with an aesthetically pleasing appearance. The bonnet 29 includes a slot 30 that permits a technician to remove and replace a condenser filter without the necessity of detaching the bonnet 29 from the housing 11.

The cooling chamber 20 contains a water line 31 that connects at an inlet to a pump 36 (described herein) and at an outlet to a carbonator mounted within the cooling chamber 20. The pump 36 connects at an inlet 38 to any suitable water source, such as a public water line, to pump water through the water line 31 into the carbonator. The carbonator is of a well known design and includes a gas inlet connected to a $CO_2$ source such as a gas cylinder. The carbonator includes an outlet connected to a manifold that delivers carbonated water to dispensing valves 100–105 to permit the dispensing of carbonated beverages.

The cooling chamber 20 further contains product coils referenced generally with numeral 32. The exact number of product coils 32 corresponds to the number of dispensing valves 100–105. Each of product coils 32 connects at an inlet to a respective product source, such as a "bag in a box" or a "figal". Each of product coils 32 further connects at an outlet to a respective one of dispensing valves 100–105. A product pump associated with each product source resides intermediate to the product sources and the product coils 32 to facilitate the delivery of product from the product sources, through the product coils 32, and to the dispensing valves 100–105.

As illustrated in FIGS. 2–6, the dispenser 10 includes a platform 33 that resides on the top surface of the housing 11. The platform 33 includes a first platform section 200 that supports a carbonator pump motor 35, a carbonator pump 36, a relief valve 68, a check valve 69, and a liquid level probe 70. The platform 33 further includes a second platform section 201 that supports an agitator 71, an electronic control housing 73, and a refrigeration unit 45. The refrigeration unit 45 includes a compressor 46, a condenser 47, a condenser fan 48, and an evaporator coil 49. The compressor 46 is of a well known design that compresses a refrigerant prior to delivery to the condenser 47 via discharge line 106. The compressor 46 is secured to the second platform section 201 using any suitable means such as cotter pins.

The condenser 47 is of a well known design that condenses the refrigerant prior to delivery to the evaporator coil 49 via capillary tube 107. The condenser 47 bolts at the left center portion of the second platform section 201. The condenser 47 includes flanges 108 and 109 for retaining a condenser filter 110 that is removable through the slot 30 in the bonnet 29.

The refrigeration unit 45 includes a condenser fan 48 of a well known design that aids in the transfer of heat from the refrigerant to the environment. The condenser fan 48 includes a motor 205 and fan blades 111 mounted on the drive shaft of the motor 205.

A shroud 51 mounts over the condenser 47 to support the condenser motor 205 and, thus, the fan blades 111 behind the condenser 47. The shroud 51 includes side casings 52 and 53 and a top casing 54 formed integrally with a rear casing (not shown). The rear casing includes an opening therethrough of sufficient size to allow the passage of the fan blades 111 of the condenser fan 48. The side casings 52 and 53 slide about the condenser 47 until the top casing 54 abuts the top surface of the condenser 47. The shroud 51 attaches to the condenser 47 via screws 57 and 58. Additionally, the bottom rear of the condenser 47 includes a pair of tabs that engage the rear casing to secure the bottom of the shroud 51.

The shroud 51 further includes brace members 55 and 56 that attach to opposing diagonal corners of the rear casing using any suitable means such as welding. The center portions of the brace members 55 and 56 include openings therethrough that permit the bolting of the condenser fan 47 to the shroud 51. The sliding of the shroud 51 onto the condenser 47 and securing thereto with the screws 57 and 58 permits easy attachment of the condenser fan 48. Conversely, the removal of the screws 57 and 58 and the sliding of the shroud 51 off the condenser 47 permits easy repair or replacement of the condenser fan 48.

The evaporator coil 49 resides underneath the platform 33 such that it extends into the cooling chamber 20. The capillary tube 107 is inserted in and passes through an opening in the second platform section 201 to couple the condenser 47 and the evaporator coil 49. The outlet end of the evaporator coil 49 passes through the opening in the platform 33 and connects to an accumulator 67. The line 112 connects the accumulator 67 and the compressor 46 to couple the compressor 46 and the evaporator coil 49, thereby making refrigeration unit 45 a closed system. The evaporator coil 49 includes spacers 62–66 that attach to the second platform section 201 using any suitable means such as brackets to support and locate the evaporator coil 49 within the cooling chamber 20. The spacers 62–66 further maintain the vertical and horizontal distance between each loop of the evaporator coil 49.

The evaporator coil 49 removes heat from the cooling fluid, resulting in the cooling fluid freezing about the evaporator coil 49 to form a frozen cooling fluid bank. The evaporator coil 49 includes an inner coil section 59, an intermediate coil section 60, and an outer coil section 61. That configuration permits the rapid development of a cooling fluid bank because the cooling fluid simultaneously freezes about each of coil sections 59–61. The cooling fluid frozen about each of coil sections 59–61 rapidly grows until it contacts an adjacent frozen portion, resulting in the adjacent portions freezing together to form one large cooling fluid bank.

Furthermore, during periods of peak use, the coil sections 59–61 maximize the surface area contact between unfrozen cooling fluid and frozen cooling fluid to maximize heat exchange therebetween. In peak use periods, the unfrozen cooling fluid circulating about the large frozen cooling fluid bank melts channels between inner coil section 59 and intermediate coil section 60 and intermediate coil section 60 and outer coil section 61. The unfrozen cooling fluid then not only circulates around the outer section 61 and through the inner coil section 59 but also through the channels between inner coil section 59 and intermediate coil section 60 and intermediate section 60 and outer coil section 61. Additionally, the unfrozen cooling fluid rapidly melts the frozen cooling fluid on the interior of the inner coil section 59 to expose the evaporator coil 49 thereby increasing heat transfer which improves efficiency.

The dispenser 10 includes an agitator 71 bolted behind the condenser 47 at the back center portion of the platform 33. The agitator 71 is of a well known design and includes a shaft 113 extending through the inner coil section 59 of the evaporator coil 49 and into the bottom of the cooling chamber 20. The shaft 113 includes a propeller 114 mounted thereto that when rotated circulates unfrozen cooling fluid about the frozen cooling fluid bank formed on the evaporator coil 49.

The dispenser 10 includes a carbonator pump 36 and a carbonator pump motor 35. In this preferred embodiment, the pump 36 and the pump motor 35 are of well known design, with the pump motor being a standard AC motor. An inlet 38 of the pump 36 connects to the standard water source, while an outlet 37 connects to the water line 31 which, in turn, connects to the fluid inlet of the carbonator contained in the cooling chamber 20. A brace 34 bolts at the front left corner of the first platform section 200 to support the motor 35 which bolts to the brace 34. The housing of the motor 35 resides above the pump 36 and threadably engages the housing of the pump 36 to support the pump 36 above the first platform section 200. The connection of the motor housing to the pump housing positions inlet 38 and outlet 37 facing forward to permit easy access by a technician. The drive shaft of the motor 35 engages the rotor of the pump 36 to operate the pump motor 35 such that it delivers water to the carbonator via the water line 31.

A relief valve 68 and a check valve 69 reside at the right front portion of the first platform section 200. The relief valve 68 and the check valve 69 mount to a line that extends from the carbonator through an opening in the first platform section 200. The line terminates in the relief valve 68 and the check valve 69 in a position above the right front portion of the first platform section 200 to allow easy access by a technician. The relief valve 68 prevents the excessive build-up of pressure within the carbonator by providing a release to excess gas pressure.

A liquid level probe 70 of a well known design bolts at the right front portion of the first platform section 200 behind the relief valve 68. The liquid level probe 70 extends through the first platform section 200 and accesses the interior of the carbonator. The liquid level probe includes a water level sensor that measures the level of the water within the carbonator.

The dispenser 10 includes a cooling fluid bank size probe 39 positioned at the left front portion of the platform 33 adjacent to the pump 36 in front of the condenser filter 110. The probe includes a fluid bank size sensor 43 of well known design mounted onto a dip stick 41 using any suitable means such as a bracket. A holder 40 attaches to the outer coil section 61 of the evaporator coil 49 in a position directly underneath an aperture 42 through the first platform section 200. The holder 40 includes a bracket 201 that surrounds and solders the evaporator coil 49. The holder 40 further includes a bracket 115 that secures to the second platform section 201 using a nut and bolt. The dip stick 41 slides within the holder 40 to permit the placement of the sensor 43 in the cooling chamber 20 in a position directly adjacent the outer coil section 61 of the evaporator coil 49. The holder includes flanges 116 and 117 that surround the edges of the dip stick 41 to maintain the dip stick 41 within the holder 40. The platform 33 includes an opening 44 therethrough directly in front of the probe 39 to permit the addition of a warmed cooling fluid directly onto the probe 39 which melts the frozen cooling fluid bank, thereby permitting easy removal of the dip stick 41 and, thus, the sensor 43.

The dispenser 10 includes an electronic control 72 disposed within a housing 73 that is bolted at the right front portion of the second platform section 201. The components and circuits comprising the electronic control 72 are well known and include a relay and start and run capacitors for the compressor 46, a start capacitor for the carbonator pump motor 35, a compressor control circuit that activates the compressor 46 responsive to the output from the cooling fluid bank size probe 39, and a carbonator pump motor control circuit that activates the motor 35 responsive to the water level output from the liquid level probe 70.

Figure 4:
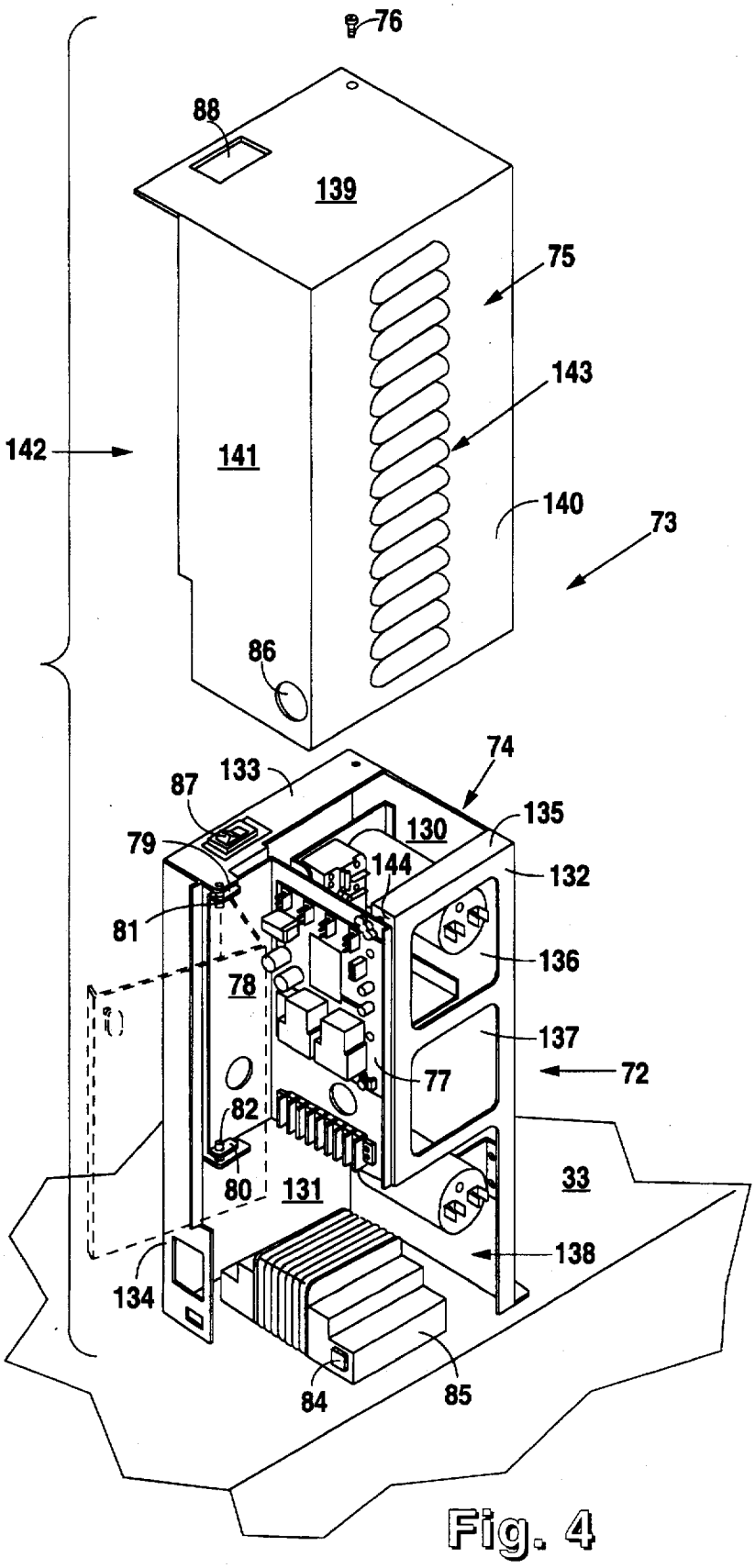
FIG. 4 is a perspective view illustrating the electronic control of the dispenser according to the preferred embodiment.

The housing 73 includes a frame 74 having a jacket 75 mounted thereabout (see FIG. 4). The frame 74 includes a casing member 130 formed integrally with casing members 131 and 132. The casing member 131 includes a top portion 133 and a front portion 134. The casing member 132 includes top portion 135, front portion 144, openings 136 and 137, and lower cut-out portion 138. The jacket 75 slides over frame 74 and is secured thereto with screw 76. The jacket 75 includes top casing member 139 formed integrally with casing members 140 and 141. The casing member 141 includes a cut-out portion 142 that is filled by front portion 134 of the casing member 131 when the jacket 75 resides over the frame 74. The casing member 140 includes vents 143 that dissipate heat delivered from the electronic control 72 via the openings 136 and 137 and the cut-out portion 138 of the casing member 132.

The positioning of the housing 73 towards the front of the platform 33 combined with the easy removal of the jacket 75 provides easy access to the electronic control 72 from the front of the dispenser 10. With the jacket 75 placed over the frame 74 and secured thereto, the reset button 84 of the transformer 85 may be accessed through opening 86 in the jacket 75. Similarly, the main power switch 87 for the electronic control 72 may be accessed through opening 88 in the jacket 75.

The removal of the jacket 75 exposes a circuit board 77 that contains the compressor control circuit and the carbonator pump motor control circuit. A door 78 supports the circuit board 77 within the frame 74. The circuit board attaches to the door 78 using any suitable means such as plastic stand-offs. The door 78 is L-shaped and pivotally mounts to the frame 74 via brackets 79 and 80 and pin 81 and 82. The pin 81 engages an aperture in the top portion 133 of the casing member 131, while the pin 82 engages an aperture in a tab riveted to the front portion 134 of the casing member 131.

The door 78 includes a locking member that secures it within the frame 74 at the end opposite from its pivotal attachment to the casing member 131. The door 78 opens to allow a technician to access the power electronics required to operate the compressor 46 and the carbonator motor 35. With the door 78 opened and pivoted away from the casing member 132, a technician can easily repair or replace the power electronics of the electronic control 72.

A major advantage of the dispenser 10 is that a technician may easily service it from the front. The condenser filter 110 may be removed and replaced through slot 30 without the necessity of removing the bonnet 29. With the removal of the bonnet 29, a technician may easily access the carbonator pump motor 35, the pump 36, the frozen cooling fluid bank size probe 39, the relief valve 68, the check valve 69, and the liquid level probe 70, all of which reside in the front of the platform 33. Additionally, the condenser 47 and the condenser fan 48 reside behind the carbonator motor 35 and the carbonator pump 36, however, as previously described, the condenser fan 48 easily slides from the condenser 47 due to its connection to the shroud 51.

The electronic control 72 resides in the right center portion of the platform directly behind the relief valve 68, the check valve 69, and the liquid level probe 70 to permit easy access. As previously described, a technician may reset the compressor transformer or deactivate the main power supply without removing the jacket 75. Additionally, with the jacket 75 removed, the circuit board 77 is easily accessible as well as the power electronics which are exposed upon the pivoting of the door 78.

Figure 7:
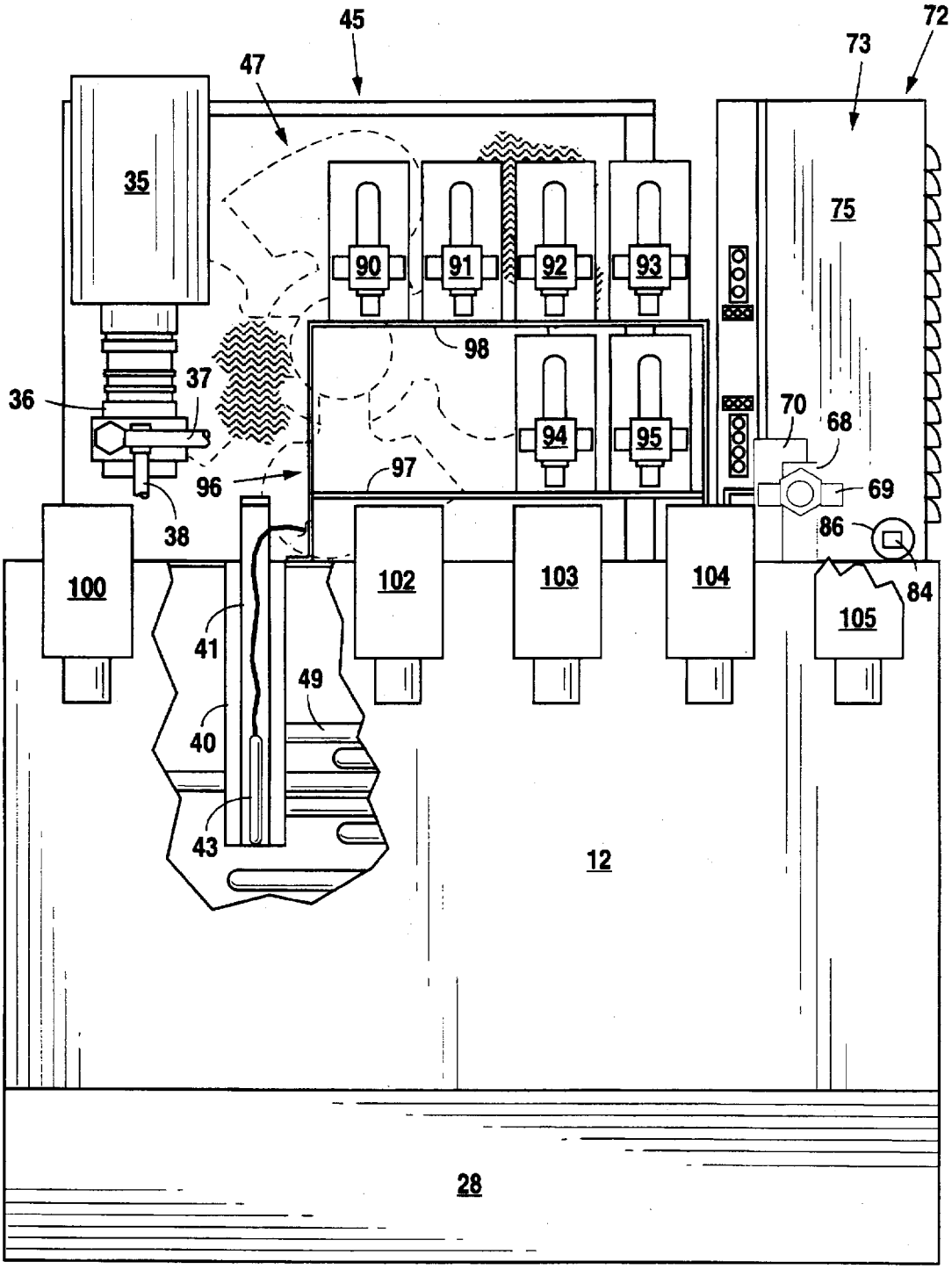
FIG. 7 is a front elevation view illustrating a dispenser according to an alternative embodiment with its bonnet removed.
Figure 8:
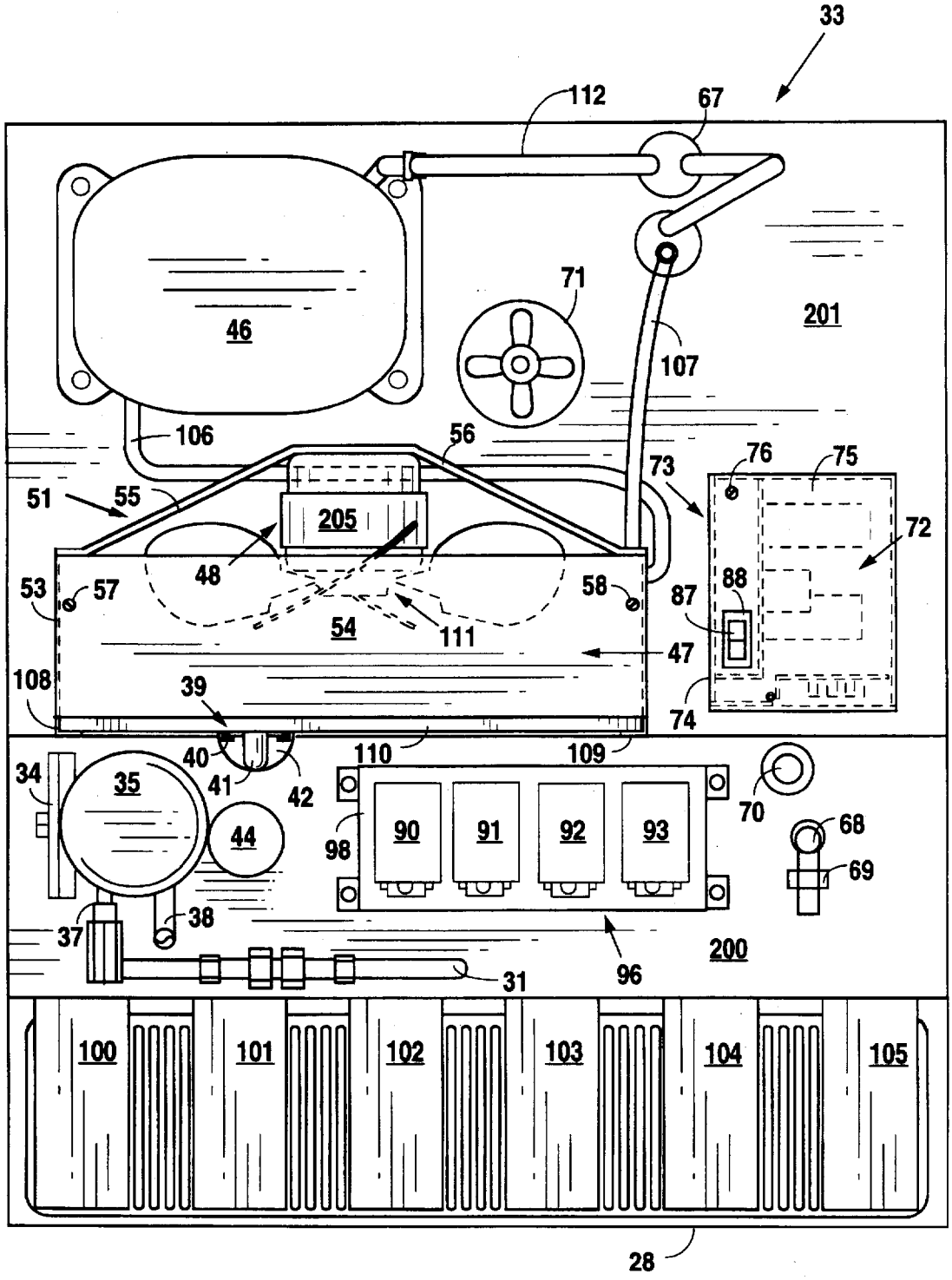
FIG. 8 is a top plan view illustrating the dispenser according to an alternative embodiment with its bonnet removed.

As illustrated in FIGS. 7 and 8, an alternative embodiment of the dispenser 10 includes product pumps 90–95 mounted at the front center portion of the first platform section 200 rather than with the separately located product source. The dispenser 10 the alternative embodiment is identical except for the mounting of the product pumps 90–95. Accordingly, like parts operate as previously described and have been referenced with like numerals.

The inlets of the product pumps 90–95 each connect to a respective product source, while the outlets from the pumps 90–95 each connect to a respective one of the product coils 32. The product pumps 90–95 are of a well known design utilized in pumping product from a product source through a respective one of the product coils 32 to a respective one of the dispensing valves 100–105.

The limited space on the platform 33 requires that the product pumps 90–95 be stacked. Accordingly, the dispenser 10 includes a frame 96 that bolts onto the first platform section 200. The frame 96 includes members 170 and 171 that support shelves 97 and 98 therebetween. The product pumps 90–95 each include feet that permit the bolting of the product pumps 90–95 to a respective shelf 97 or 98. The shelf 98 is horizontal with respect to the platform 33, while the shelf 97 cants forward. If the product pumps 94 and 95 were positioned on a horizontal plane, they would be extremely difficult to remove because the shelf 98 would interfere. However, the downward sloping of the shelf 97 from its back to its front cants the pumps 94 and 95, resulting in the plane parallel to their attachment bolts residing in front of the shelf 98. Accordingly, a tool used by a technician to remove the attachment bolts of the product pumps 94 and 95 will be in front of the shelf 98, which greatly simplifies the removal of the product pumps 94 and 95. Although the shelf 98 was described as horizontal, one of ordinary skill in the art will recognize that any level of canted shelves may be used with only the top shelf being horizontal.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims that follow.

We claim:

1. A component configuration for enhancing the serviceability of a dispenser, said dispenser including a housing having a cooling chamber, said component configuration comprising:

a platform positionable on said housing;

an electronic control; and a housing for said electronic control mounted on said platform, said housing, comprising:

a frame for supporting said electronic control, a jacket slidable over said frame wherein the removal of said jacket from said frame exposes said electronic control, and a door for supporting first circuits of said electronic control, said door pivotally mounted to said frame wherein the pivoting of said door to an open position exposes second circuits of said electronic control.

2. The component configuration according to claim 1 further comprising a refrigeration unit mounted on said platform.

3. A component configuration for enhancing the serviceability of a dispenser, said dispenser including a housing having a cooling chamber, said component configuration comprising:

a platform positionable on said housing;

a refrigeration unit mounted on said platform;

a cooling fluid bank size probe mounted at a front portion of said platform; and said platform including an opening therethrough positioned in front of said cooling fluid bank size probe.

4. A component configuration for enhancing the serviceability of a dispenser, said dispenser including a housing having a cooling chamber, said component configuration comprising:

a platform positionable on said housing; and a frame mounted at the front portion of the platform, said frame comprising:

a first shelf for supporting a first dispensing pump, and a second shelf for supporting a second dispensing pump wherein said second shelf is positioned under said first shelf and resides at an angle to enhance the accessibility of said second dispensing pump.

5. The component configuration according to claim 1 wherein said jacket includes an opening therethrough that exposes a switch of the electronic control.

6. The component configuration according to claim 3 further comprising:

a carbonator pump motor mounted at a front portion of said platform;

a carbonator pump attached to and supported by said carbonator pump motor.

7. The component configuration according to claim 3 further comprising a relief valve and a check valve for the carbonator mounted at a front portion of said platform.

8. The component configuration according to claim 3 further comprising a liquid level probe for a carbonator mounted at a front portion of said platform.

9. The component configuration according to claim 1 further comprising an agitator mounted on said platform.

10. The component configuration according to claim 4 further comprising dispensing valves mounted to an upper front portion of said housing of said dispenser.

11. The component configuration according to claim 4 wherein said frame comprises side members that support said first and second shelves therebetween.

12. The component configuration according to claim 11 wherein said side members include feet for permitting the attachment of said side members to said platform.

* * * * *